US005547258A

United States Patent [19]

Lin

[11] Patent Number: 5,547,258

[45] Date of Patent: Aug. 20, 1996

[54] DECK CHAIR ASSEMBLY

[76] Inventor: Steve Lin, No. 80, Kengtsai Ping, Hoping Village, Chuchi Hsiang, Chiayi Hsien, Taiwan

[21] Appl. No.: 455,842

[22] Filed: May 31, 1995

[51] Int. Cl.[6] ..... A47C 4/02

[52] U.S. Cl. ..... 297/440.22; 297/440.1; 297/440.24

[58] Field of Search ..... 297/440.1, 440.22, 297/440.24; 108/157, 180

[56] References Cited

U.S. PATENT DOCUMENTS

| | | | |
|---|---|---|---|
| 855,520 | 6/1907 | Margolin | 297/440.24 X |
| 4,299,423 | 11/1981 | Saiger | 297/440.24 |
| 4,784,436 | 11/1988 | Sutherland | 297/440.24 |
| 5,427,435 | 6/1995 | Yoder, Jr. | 297/440.24 X |
| 5,429,417 | 7/1995 | Kim | 297/440.22 X |

*Primary Examiner*—Peter R. Crown

*Attorney, Agent, or Firm*—Hedman, Gibson & Costigan, P.C.

[57] ABSTRACT

A deck chair assembly includes a body. A first supporting member is mounted on an underside of a first end portion of the body. At least one second supporting member is mounted on an underside of a mediate end portion of the body. A third supporting member is mounted on an underside of a second end portion of the body. A first L-shaped member includes a horizontal portion fitted in a first end of the third supporting member. A second L-shaped member includes a horizontal portion fitted in a second end of the third supporting member. A first positioning member includes a first outer sleeve mounted on a first leg of the first supporting member, at least one second outer sleeve mounted on a first leg of the second supporting member, and a third outer sleeve mounted on a vertical portion of the first L-shaped member. A second positioning member includes a fourth outer sleeve mounted on a second leg of the first supporting member, at least one fifth outer sleeve mounted on a second leg of the second supporting member, and a sixth outer sleeve mounted on a vertical portion of the second L-shaped member.

4 Claims, 4 Drawing Sheets

DECK CHAIR ASSEMBLY

BACKGROUND OF THE INVENTION

1. Field of Invention

The present invention relates to a deck chair assembly.

2. Related Prior Art

A conventional deck chair is pre-assembled after the manufacture is finished, thereby occupying a large space and volume during the conveying process thereof. In addition, the conventional deck chair is fixedly erected without being able to be assembled and dismantled by a consumer himself/herself.

The present invention has arisen to mitigate and/or obviate disadvantages of the conventional deck chair.

SUMMARY OF THE INVENTION

The primary objective of the present invention is to provide a built-up deck chair assembly.

In accordance with one aspect of the present invention, there is provided a deck chair assembly comprising a body which includes a first end portion, a mediate flat portion and a second end portion. A first supporting member substantially inverted U-shaped in section is fixedly mounted on an underside of the first end portion of the body and includes a first leg and a second leg. At least one second supporting member substantially inverted U-shaped in section is fixedly mounted on an underside of the mediate end portion of the body and includes a first leg and a second leg. A third supporting member is fixedly mounted on an underside of the second end portion of the body and includes a first end and a second end.

A first L-shaped member includes a horizontal portion fitted in the first end of the third supporting member and a vertical portion. A second L-shaped member includes a horizontal portion fitted in the second end of the third supporting member and a vertical portion.

A first positioning member includes a first outer sleeve mounted on the first leg of the first supporting member, at least one second outer sleeve mounted on the first leg of the second supporting member, and a third outer sleeve mounted on the vertical portion of the first L-shaped member. A second positioning member includes a fourth outer sleeve mounted on the second leg of the first supporting member, at least one fifth outer sleeve mounted on the second leg of the second supporting member, and a sixth outer sleeve mounted on the vertical portion of the second L-shaped member.

In addition, a backrest includes a lower portion pivotably engaged with the second end portion of the body. A first wheel is rotatably mounted on the first positioning member, and a second wheel is rotatably mounted on the second positioning member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
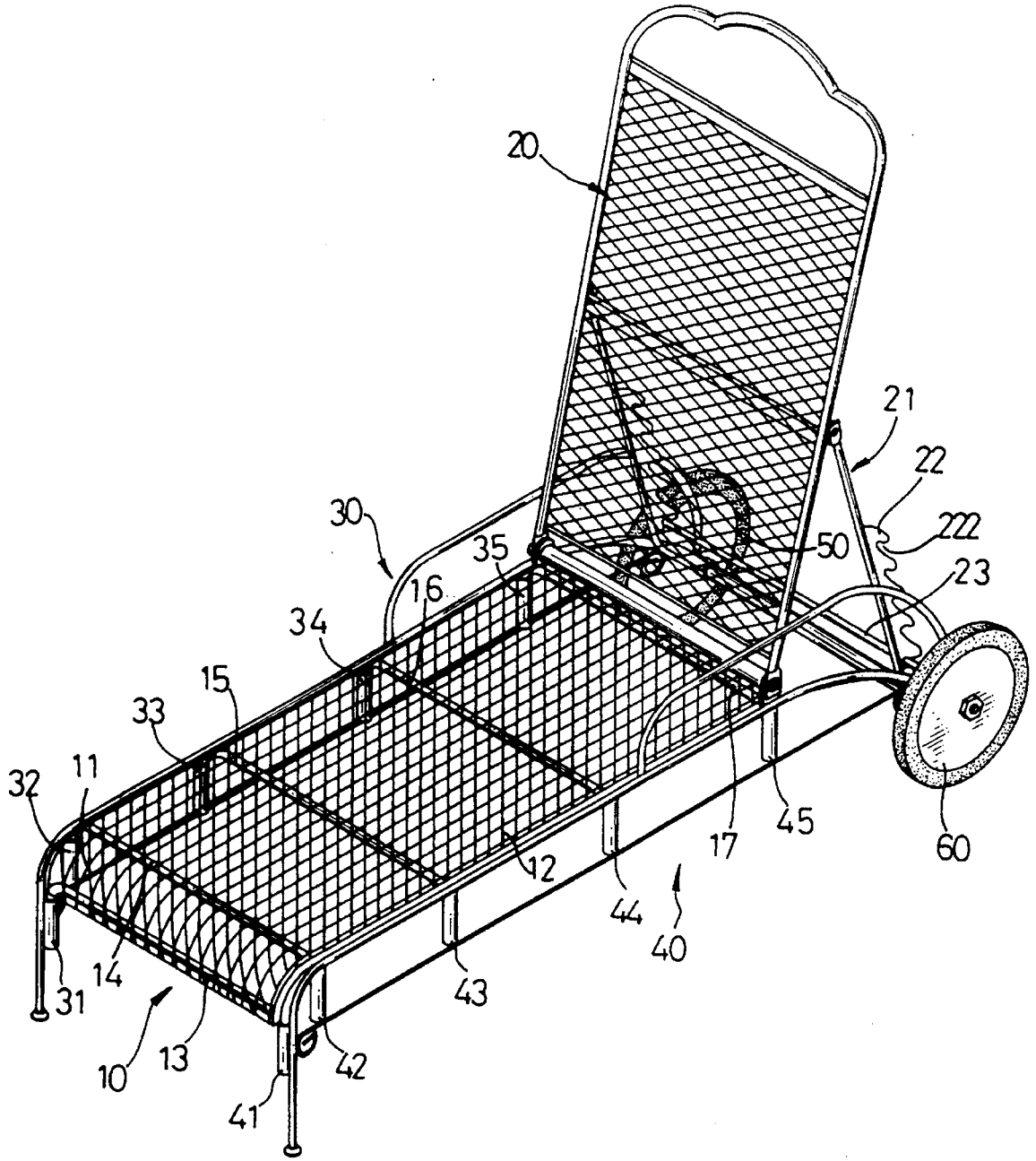
FIG. 1 is a perspective view of a deck chair assembly in accordance with the present invention.
Figure 2:
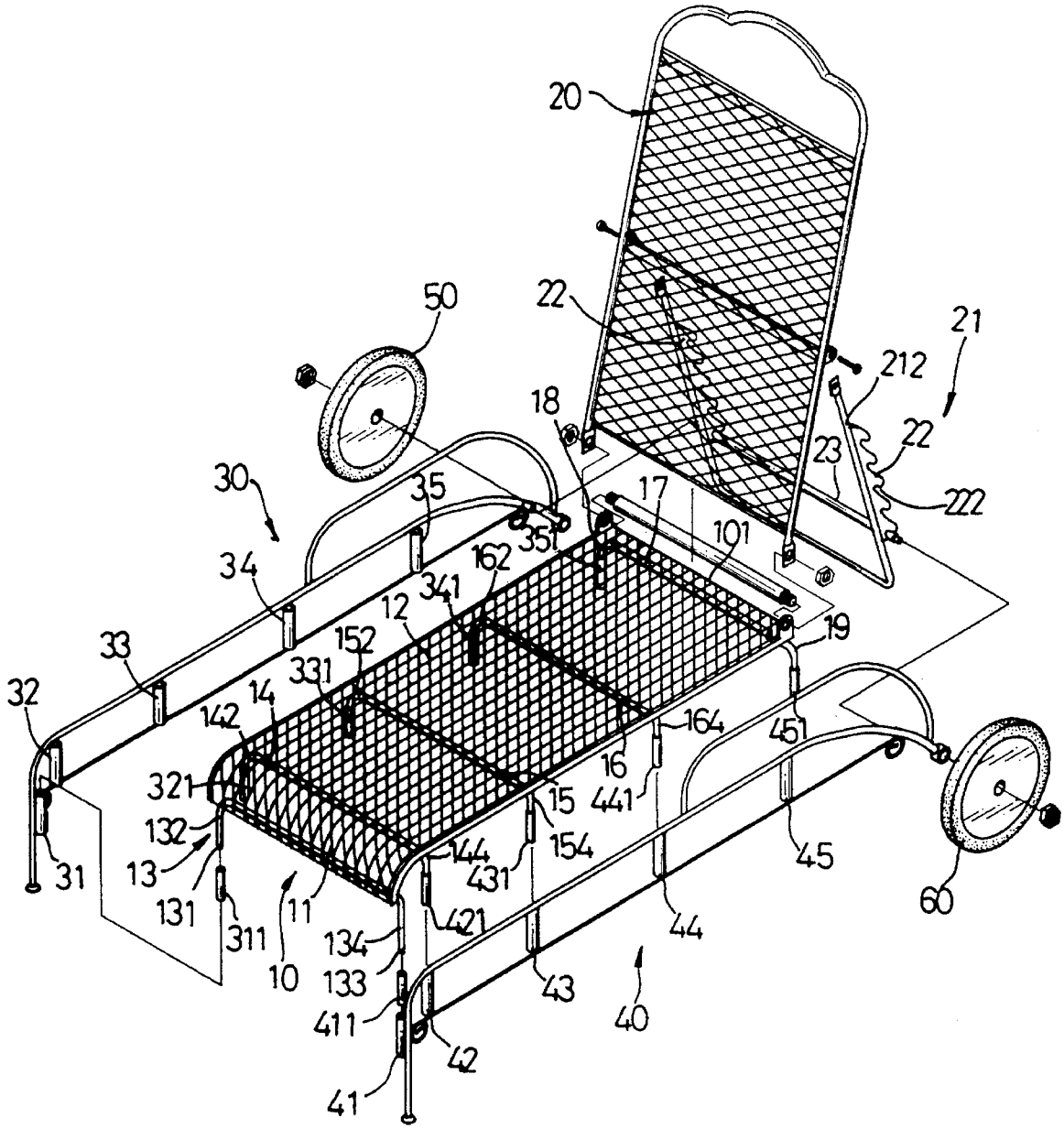
FIG. 2 is an exploded view of the deck chair assembly as shown in FIG. 1.

Referring to the drawings, and initially to FIGS. 1 and 2, a built-up deck chair assembly in accordance with the present invention comprises a body 10 including a first end portion 11, a mediate flat portion 12 and a second end portion 101. Preferably, the first end portion of the body 10 has an arcuate configuration.

A first supporting member 13 substantially inverted U-shaped in section is fixedly mounted on an underside of the first end portion 11 of the body 10 and includes a first leg 132 and a second leg 134. Three second supporting members 14, 15, 16 substantially inverted U-shaped in section are fixedly mounted on an underside of the mediate end portion 12 of the body 10 respectively and each include a first leg 142, 152, 162 and a second leg 144, 154, 164.

Figure 5:
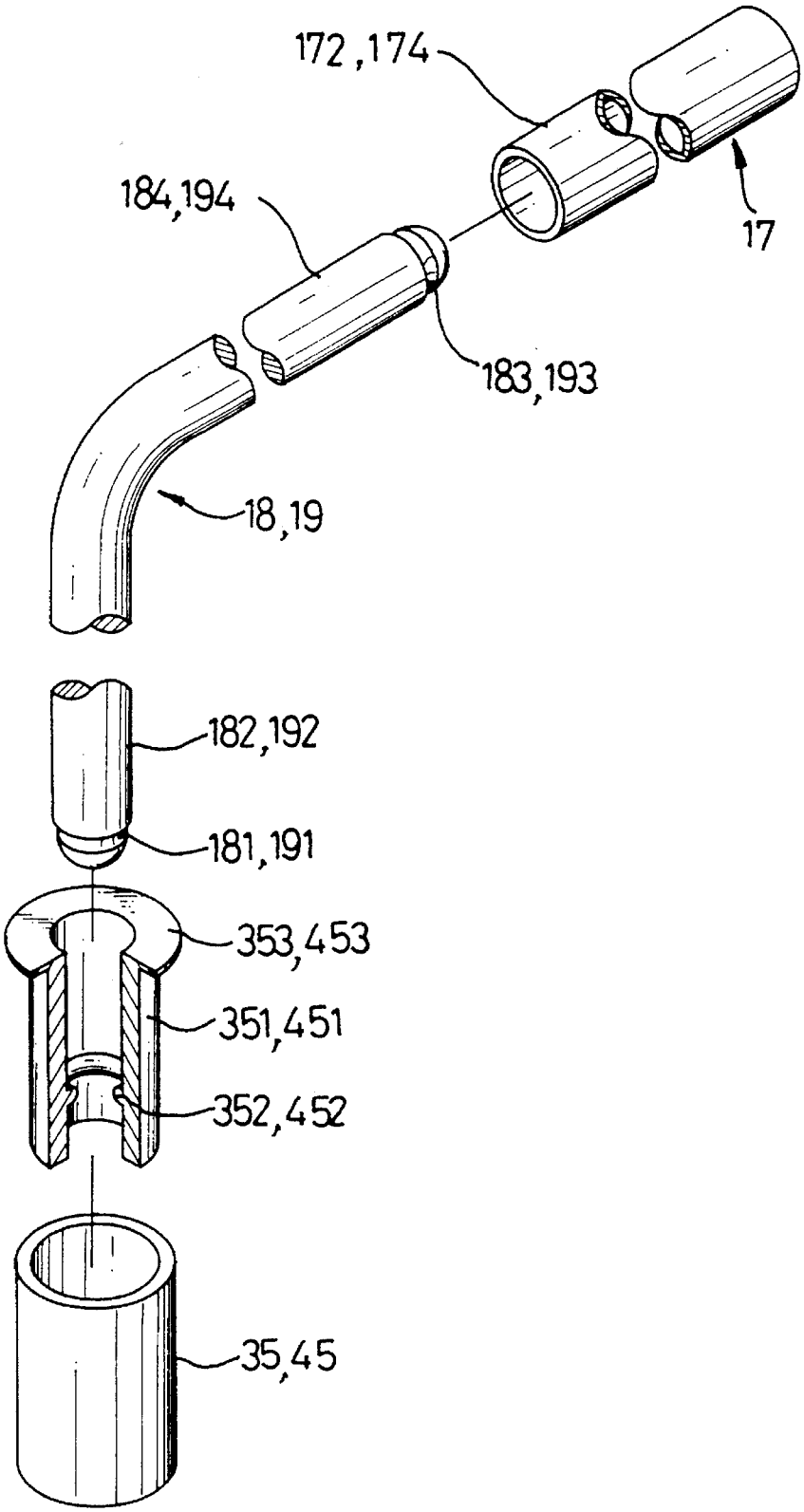
FIG. 5 is a partially cross-sectional exploded view showing a supporting member, an L-shaped member, an inner sleeve and an outer sleeve.

Referring to FIGS. 2 and 5, a third supporting member 17 is fixedly mounted on an underside of the second end portion 101 of the body 10 and includes a first end 172 and a second end 174. A first L-shaped member 18 includes a horizontal portion 184 fitted in the first end 172 of the third supporting member 17 and a vertical portion 182. A second L-shaped member 19 includes a horizontal portion 194 fitted in the second end 174 of the third supporting member 17 and a vertical portion 192.

A first positioning member 30 includes a first outer sleeve 31 mounted around the first leg 132 of the first supporting member 13, three second outer sleeves 32, 33, 34 mounted around the first legs 142, 152, 162 of the second supporting members 14, 15, 16, and a third outer sleeve 35 mounted around the vertical portion 182 of the first L-shaped member 18. A second positioning member 40 includes a fourth outer sleeve 41 mounted around the second leg 134 of the first supporting member 13, three fifth outer sleeves 42, 43, 44 mounted around the second legs 144, 154, 164 of the second supporting members 14, 15, 16, and a sixth outer sleeve 45 mounted around the vertical portion 192 of the second L-shaped member 19.

A first wheel 50 is rotatably mounted on the first positioning member 30, and a second wheel 60 is rotatably mounted on the second positioning member 40.

A backrest 20 includes a lower portion pivotably engaged with the second end portion 101 of the body 10. A crossbar 23 is fixedly mounted between the first and second positioning members 30 and 40. A reclining brace 21 substantially U-shaped in section includes two vertical posts 212 each pivotally engaged with a mediate portion of the backrest 20. There are two adjusting members 22 each respectively mounted on a corresponding one of the vertical posts 212. A plurality of notches 222 are defined in each of the two adjusting members 22 for being detachably engaged with the crossbar 23.

Figure 4:
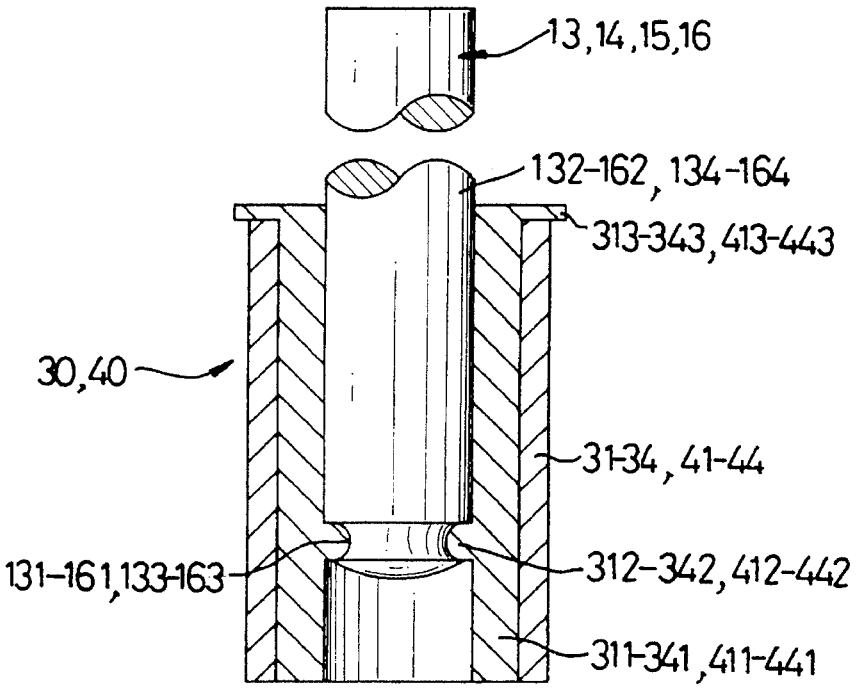
FIG. 4 is a cross-sectional assembly view of the supporting member, inner sleeve and outer sleeve as shown in FIG. 3.
Figure 3:
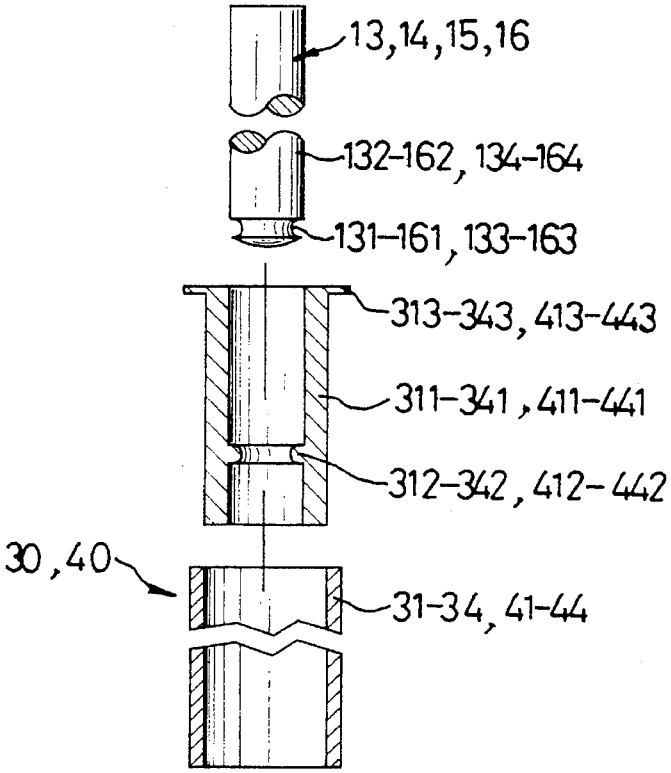
FIG. 3 is a cross-sectional view showing a supporting member, an inner sleeve and an outer sleeve which are disposed in an exploded status.

Referring to FIGS. 2–4, there are four inner sleeves 311–341 each respectively mounted between the first legs 132–162 of the supporting members 13–16 and the outer sleeves 31–34 of the first positioning member 30, and four inner sleeves 411–441 each respectively mounted between the second legs 134–164 of the supporting members 13–16 and the outer sleeves 41–44 of the second positioning member 40.

Annular grooves 131–161 are respectively defined along an outer periphery of the first legs 132–162 of the supporting members 13–16, and annular grooves 133–163 are respectively defined along an outer periphery of the second legs 134–164 of the supporting members 13–16.

Annular projections 312–342 are respectively formed on an inner periphery of the inner sleeves 311–341 and extend radially and inwardly therefrom for being engaged in the associated annular grooves 131–161, thereby respectively retaining the first legs 132–162 of the supporting members 13–16 in the associated inner sleeves 311–341, and annular projections 412–442 are respectively formed on an inner periphery of the inner sleeves 411–441 and extend radially and inwardly therefrom for being engaged in the associated annular grooves 133–163, thereby respectively retaining the second legs 134–164 of the supporting members 13–16 in the associated inner sleeves 411–441.

Annular flanges 313–343 are respectively formed on an outer periphery of the inner sleeves 311–341 and extend radially and outwardly therefrom for stopping upward movement of the outer sleeves 31–34, and annular flanges 413–443 are respectively formed on an outer periphery of the inner sleeves 411–441 and extend radially and outwardly therefrom for stopping upward movement of the outer sleeves 41–44.

Referring to FIG. 5, inner sleeves 351, 451 are respectively mounted between the vertical portions 182, 192 of the L-shaped members 18, 19 and the outer sleeves 35, 45. Annular grooves 181, 191 are respectively defined along an outer periphery of the vertical portions 182, 192 of the L-shaped members 18, 19.

Annular projections 352, 452 are respectively formed on an inner periphery of the inner sleeves 351, 451 for being engaged in the associated grooves 181, 191, thereby respectively retaining the vertical portions 182, 192 of the L-shaped member 18, 19 in the associated inner sleeves 351, 451. Annular flanges 353, 453 are respectively formed on an outer periphery of the inner sleeves 351, 451 for stopping upward movement of the associated outer sleeves 35, 45.

Annular grooves 183, 193 are respectively defined along an outer periphery of the horizontal portions 184, 194 of the L-shaped members 18, 19. Annular projections (not shown) are respectively formed on an inner periphery of the first and second ends 172, 174 of the supporting member 17 for being engaged in the associated grooves 183, 193, thereby respectively retaining the horizontal portions 184, 194 of the L-shaped member 18, 19 in the supporting member 17.

In assembly, referring to FIGS. 1–2 with reference to FIGS. 3–5, the inner sleeves 311–341 and 411–441 are respectively fitted around the associated legs 132–162 and 134–164 of the supporting members 13–16. The horizontal portions 184, 194 of the L-shaped members 18, 19 are respectively fitted in the supporting member 17 and the inner sleeves 351, 451 are respectively fitted around the associated vertical portions 182, 192 of the L-shaped members 18, 19.

The positioning members 30, 40 are then attached to the body 10 with the outer sleeves 31–35 and 41–45 thereof being fitted around the associated inner sleeves 311–351 and 411–451.

The backrest 20 is subsequently pivotally attached to the body 10 and the crossbar 23 is fitted between the two positioning members 30, 40. The reclining brace 21 is pivotally attached to the backrest 20 with the two adjusting members 22 resting on the crossbar 23, thereby easily adjusting the tilting level of the backrest 20 by means of detachable engagement between the plurality of notches 222 of the adjusting members 22 and the crossbar 23.

Finally, the two wheels 50, 60 are rotatably mounted on the positioning members 30, 40 respectively, thereby accomplishing the assembling process of the deck chair assembly.

It should be clear to those skilled in the art that further embodiments of the present invention may be made without departing from the teachings of the present invention.

What is claimed is:

1. A deck chair assembly comprising:

a body (10) including a first end portion (11), a mediate flat portion (12) and a second end portion (101);

a first supporting member (13) substantially inverted U-shaped in section being fixedly mounted on an underside of the first end portion (11) of said body (10) and including a first leg (132) and a second leg (134);

at least one second supporting member (14, 15, 16) substantially inverted U-shaped in section being fixedly mounted on an underside of the mediate end portion (12) of said body (10) and including a first leg (142, 152, 162) and a second leg (144, 154, 164);

a third supporting member (17) fixedly mounted on an underside of the second end portion (101) of said body (10) and including a first end (172) and a second end (174);

a first L-shaped member (18) having a horizontal portion (184) fitted in the first end (172) of said third supporting member (17) and a vertical portion (182);

a second L-shaped member (19) having a horizontal portion (194) fitted in the second end (174) of said third supporting member (17) and a vertical portion (192);

a first positioning member (30) including a first outer sleeve (31) mounted on said first leg (132) of said first supporting member (13), at least one second outer sleeve (32, 33, 34) mounted on said first leg (142, 152, 162) of said second supporting member (14, 15, 16), and a third outer sleeve (35) mounted on said vertical portion (182) of said first L-shaped member (18);

a second positioning member (40) including a fourth outer sleeve (41) mounted on said second leg (134) of said first supporting member (13), at least one fifth outer sleeve (42, 43, 44) mounted on said second leg (144, 154, 164) of said second supporting member (14, 15, 16), and a sixth outer sleeve (45) mounted on said vertical portion (192) of said second L-shaped member (19);

a backrest (20) having a lower portion pivotably engaged with the second end portion (101) of said body (10); and a first wheel (50) rotatably mounted on said first positioning member (30), and a second wheel (60) rotatably mounted on said second positioning member (40).

2. The deck chair assembly in accordance with claim 1, further comprising an inner sleeve (311) mounted between said first leg (132) of said first supporting member (13) and said first outer sleeve (31) of said first positioning member (30), an annular groove (131) being defined along an outer periphery of said first leg (132) of said first supporting member (13), an annular projection (312) formed on an inner periphery of said inner sleeve (311) and extending radially and inwardly therefrom for being engaged in said annular groove (131), an annular flange (313) formed on an outer periphery of said inner sleeve (311) and extending radially and outwardly therefrom for stopping upward movement of said first outer sleeve (31).

3. The deck chair assembly in accordance with claim 1, wherein said first end portion of said body (10) has an arcuate configuration.

4. The deck chair assembly in accordance with claim 1, further comprising a crossbar (23) fixedly mounted between said first and second positioning members (30) (40), a reclining brace (21) substantially U-shaped in section including two vertical posts (212) each pivotally engaged with a mediate portion of said backrest (20), two adjusting members (22) each respectively mounted on a corresponding one of said vertical posts (212), a plurality of notches (222) defined in each of said two adjusting members (22) for being detachably engaged with said crossbar (23).

* * * * *